US005815119A

United States Patent [19]

Helms et al.

[11] Patent Number: 5,815,119

[45] Date of Patent: Sep. 29, 1998

[54] INTEGRATED STACKED PATCH ANTENNA POLARIZER CIRCULARLY POLARIZED INTEGRATED STACKED DUAL-BAND PATCH ANTENNA

[75] Inventors: Darrell L. Helms, Seminole; James R. Sherman; Barry B. Pruett, both of St. Petersburg, all of Fla.

[73] Assignee: E-Systems, Inc., Dallas, Tex.

[21] Appl. No.: 694,855

[22] Filed: Aug. 8, 1996

[51] Int. Cl.[6] ..... H01Q 1/38; H01Q 21/24

[52] U.S. Cl. ..... 343/700 MS; 343/853

[58] Field of Search ..... 343/700 MS, 846, 343/830, 850, 853; H01Q 1/38, 21/24, 21/00, 21/30

[56] References Cited

U.S. PATENT DOCUMENTS

| | | | |
|---|---|---|---|
| 3,605,097 | 9/1971 | Hadik-Barkoczy | 343/739 |
| 4,089,003 | 5/1978 | Conroy | 343/700 MS |
| 4,125,838 | 11/1978 | Kaloi | 343/700 MS |
| 4,218,682 | 8/1980 | Yu | 343/700 MS |
| 4,660,048 | 4/1987 | Doyle | 343/700 MS |
| 4,783,661 | 11/1988 | Smith | 343/700 MS |
| 4,827,271 | 5/1989 | Berneking et al. | 343/700 MS |
| 4,924,236 | 5/1990 | Schuss | 343/700 MS |
| 5,006,859 | 4/1991 | Wong | 343/700 MS |
| 5,099,249 | 3/1992 | Seavey | 343/700 MS |
| 5,121,127 | 6/1992 | Toriyama | 343/700 MS |
| 5,124,733 | 6/1992 | Haneishi | 343/700 MS |
| 5,153,600 | 10/1992 | Metzler | 343/700 MS |
| 5,165,109 | 11/1992 | Han et al. | 343/700 MS |
| 5,408,241 | 4/1995 | Shattuck et al. | 343/700 MS |
| 5,444,452 | 8/1995 | Itoh | 343/700 MS |

FOREIGN PATENT DOCUMENTS

| | | | |
|---|---|---|---|
| 0 542 595 A1 | 10/1992 | European Pat. Off. | 343/700 MS |

*Primary Examiner*—Michael C. Wimer
*Attorney, Agent, or Firm*—Baker & Botts, L.L.P.

[57] ABSTRACT

A dual band, stacked microstrip antenna produces circular polarization. A two-layer, 90° microstrip coupler is mounted to a hi-band patch and a lo-band patch and provides two inputs to the antenna to excite two orthogonal linearly polarized radiation patterns in quadrature. The coupler outputs are connected to the antenna by two conducting pins that connect directly to the groundplane of the lower patch. The coupler uses the hi-band patch as a groundplane and is transparent to the radiation from the antenna. An antenna input connector is connected to the coupler input by means of a coaxial line through the center of the antenna. The isolation port is terminated in a surface mounted 50-ohm resister to ground through a quarter wave length open transmission line.

14 Claims, 3 Drawing Sheets

INTEGRATED STACKED PATCH ANTENNA POLARIZER CIRCULARLY POLARIZED INTEGRATED STACKED DUAL-BAND PATCH ANTENNA

TECHNICAL FIELD

This invention relates generally to controlled radiation pattern GPS antennas and, more particularly, to a dual-band, stacked microstrip antenna producing circular polarization.

BACKGROUND OF THE INVENTION

Phased array antennas are used in many applications and are favored for their versatility. Phased array antennas respond almost instantaneously to beam steering changes, and are well suited for adaptive beam forming systems. Integrated circuitry has been used to reduce the cost of phased arrays. Patch element arrays have proven particularly useful for compact low profile uses such as in airborne or space service.

A patch radiator comprises a conductive plate, or patch, separated from a ground plane by a dielectric medium. When an RF current is conducted within the cavity formed between the patch and its ground plane, an electric field is excited between the two conductive surfaces. It is the fringe field, between the outer edges of the patch and the ground plane, that generates the usable electromagnetic waves into free space. A low-profile radiator is one in which the thickness of the dielectric medium is typically less than one-tenth wavelength.

Patch radiators support a variety of feed configurations and are capable of generating circular polarization. U.S. Pat. No. 4,924,236; U.S. Pat. No. 4,660,048; U.S. Pat. No. 4,218,682; U.S. Pat. No. 4,218,682; U.S. Pat. No. 5,124,733; and U.S. Pat. No. 5,006,859 describe the use of stacked patch radiators for use as an array antenna.

SUMMARY OF THE INVENTION

The present invention is a dual band, stacked microstrip antenna that is circularly polarized. The antenna employs a two-layer, 90° microstrip coupler mounted atop a hi-band patch and provides two inputs to the antenna to excite two orthogonal linear polarizations in quadrature. The coupler outputs are connected to the antenna by two conducting pins connected directly to the groundplane of the lo-band patch. The coupler uses the hi-band patch as a groundplane and is transparent to the radiation from the antenna. An input connector is connected to the coupler input by means of a coaxial line through the center of the antenna at zero RF potential. The isolation port is terminated in a surface mounted 50-ohm resister connected to a ground through a quarter wavelength open transmission line.

In accordance with the present invention, the quadrature signals required to produce circular polarization are generated in a microstrip coupler on top of the antenna and fed downward. The present invention provides a low-cost method for converting a linearly polarized patch antenna to circular polarization.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
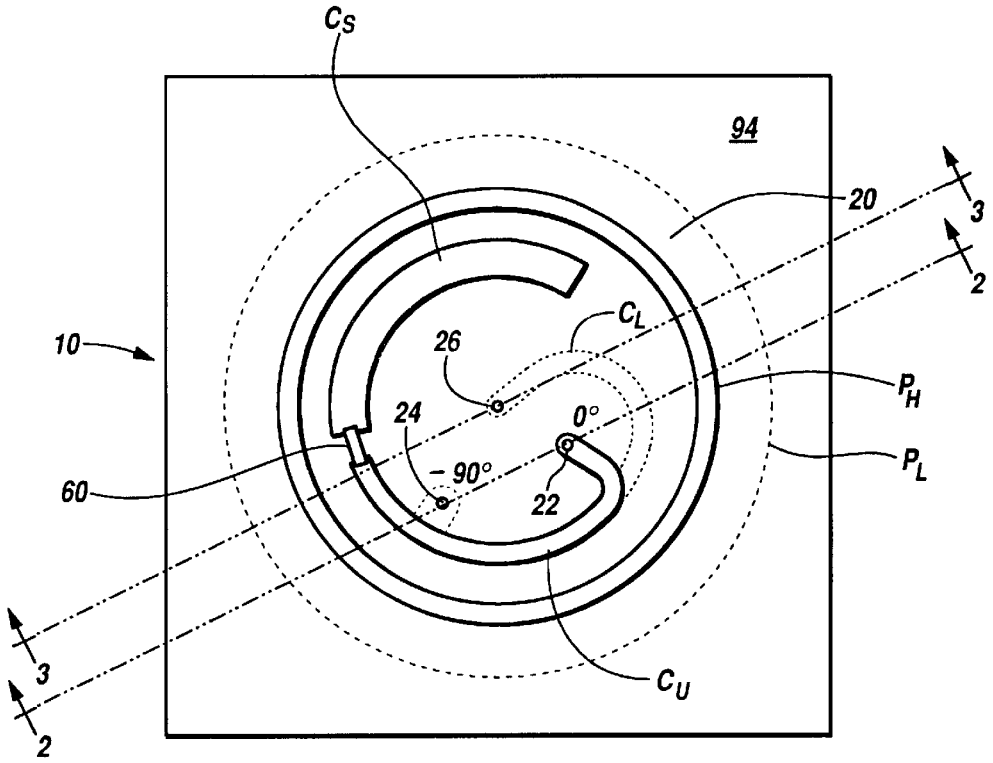
FIG. 1 is a plan view of the top of an integrated stacked microstrip antenna of the present invention.
Figure 1A:
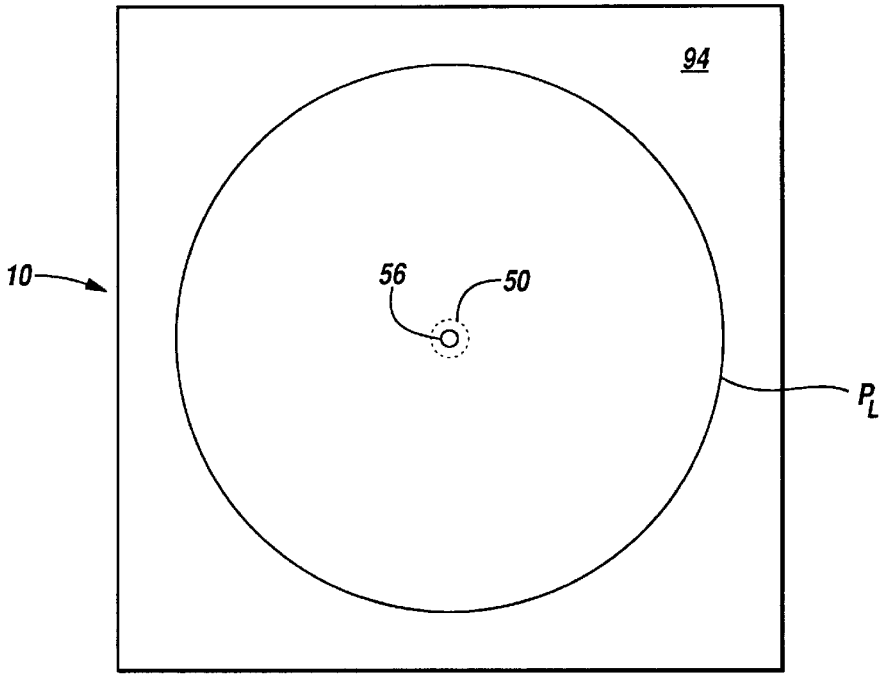
FIG. 1A is a plan view illustrating a lower patch and substrate of the antenna of the present invention.
Figure 2:
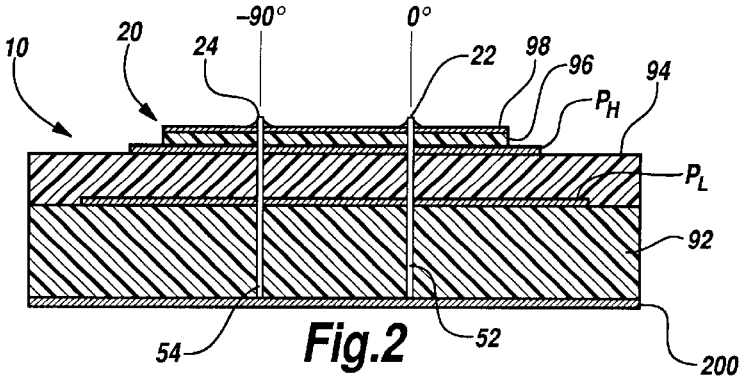
FIG. 2 is a side view of the antenna of the present invention taken at section 2—2 in FIG. 1.

Reference is now made to the Drawings wherein like reference characters denote like or similar parts throughout the eight FIGURES. Referring to FIGS. 1, 1A, 2 and 3, therein is illustrated the integrated stacked patch antenna polarizer 10 of the present invention. A two-layer, 90° microstrip coupler 20 is mounted to a hi-band patch $P_H$ and a dielectric substrate 94 of approximately 0.100 inch thickness (FIGS. 1 and 2). A lo-band patch $P_L$ (FIG. 1A) and a dielectric substrate 92 of approximately 0.250 inch thickness is mounted adjacent to and below the hi-band patch $P_H$ and the substrate 94 (FIG. 2).

Figure 3:
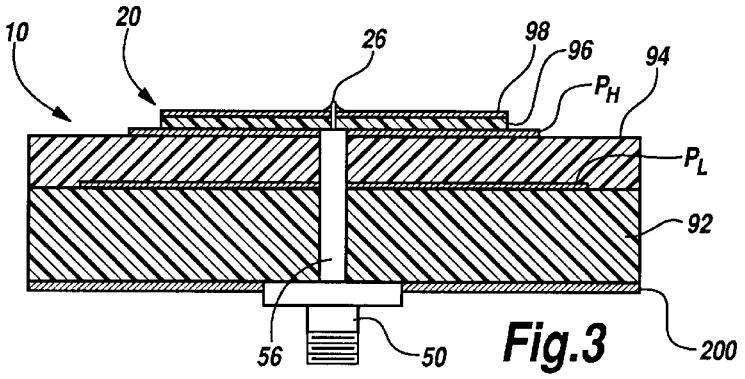
FIG. 3 is a side view of the antenna of the present invention taken at section 3—3 in FIG. 1.

The coupler 20 includes a 0° output terminal 22 and a −90° output terminal 24 connected by two conducting pins 52 and 54 (or plated through hole conductors in the substrates) directly to the groundplane 200 of the lo-band patch $P_L$ (FIGS. 1,2 and 3). The groundplane 200 is connected to an outer shell of the input connector 50 (FIG. 3). The hi-band patch $P_H$ is the groundplane for the coupler 20 and is nearly transparent to the radiation from the hi-band patch $P_H$ and the lo-band patch $P_L$ of the antenna 10. An input terminal 26 of the coupler 20 is connected to the input connector 50 by means of a coaxial line 56 through the center of the antenna 10 (FIGS. 1 and 3). The center of the antenna 10 is at zero RF potential.

Figure 5:
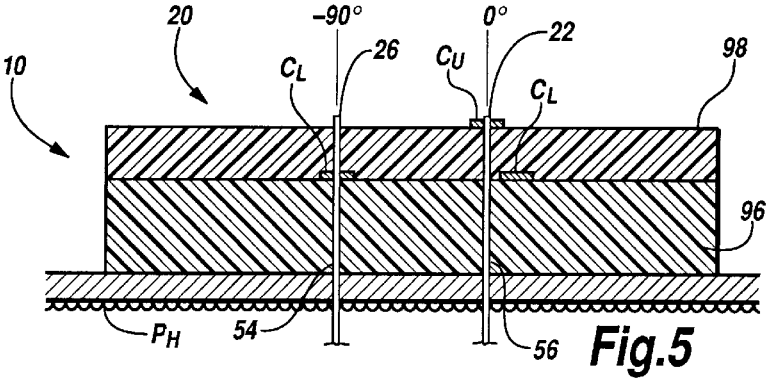
FIG. 5 is an enlarged partial side view of the 90° microstrip coupler taken at section 5—5 in FIG. 4.
Figure 6:
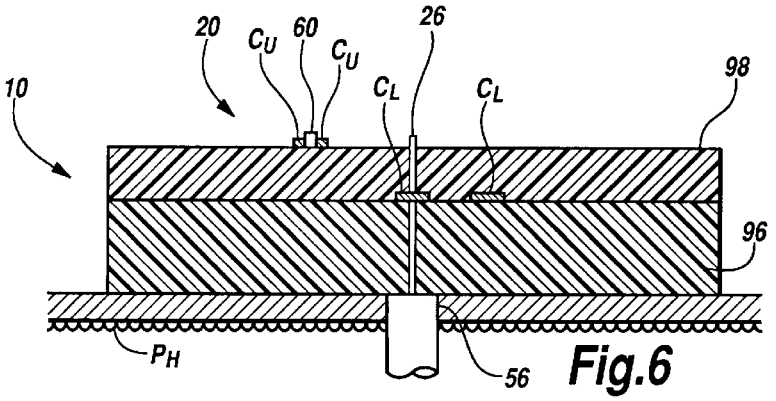
FIG. 6 is an enlarged partial side view of the 90° microstrip coupler taken at section 6—6 in FIG. 4.
Figure 4:
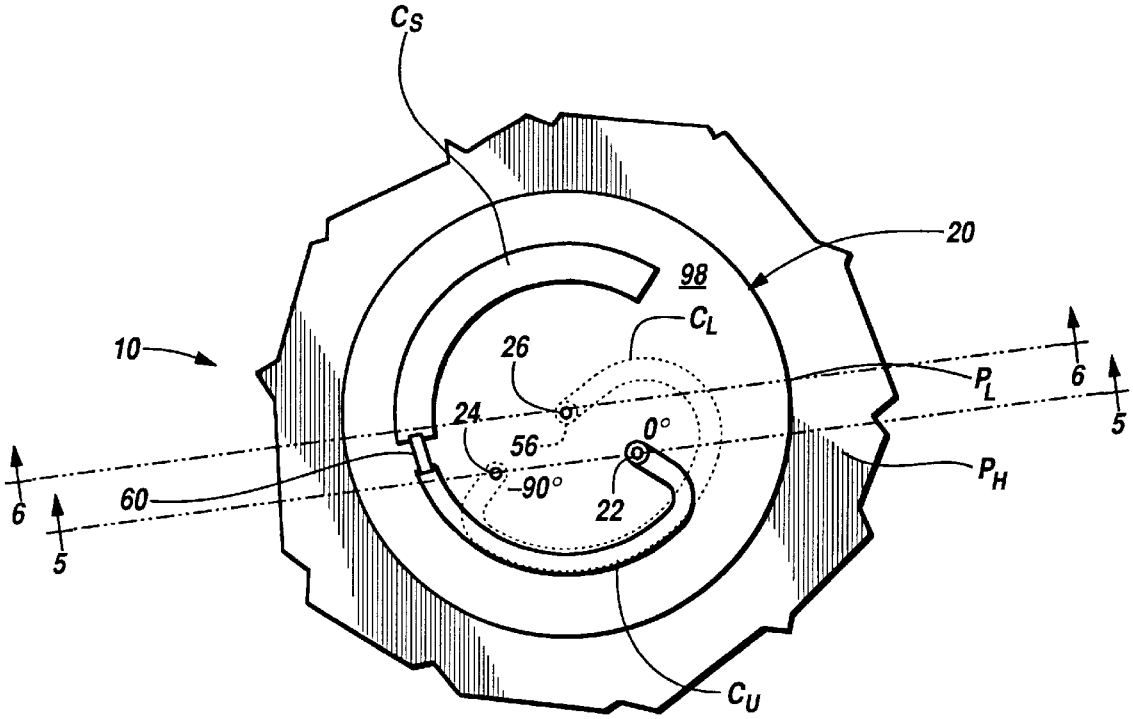
FIG. 4 is a partial plan view of the top of a 90° microstrip coupler of the antenna of FIG. 1.
Figure 4A:
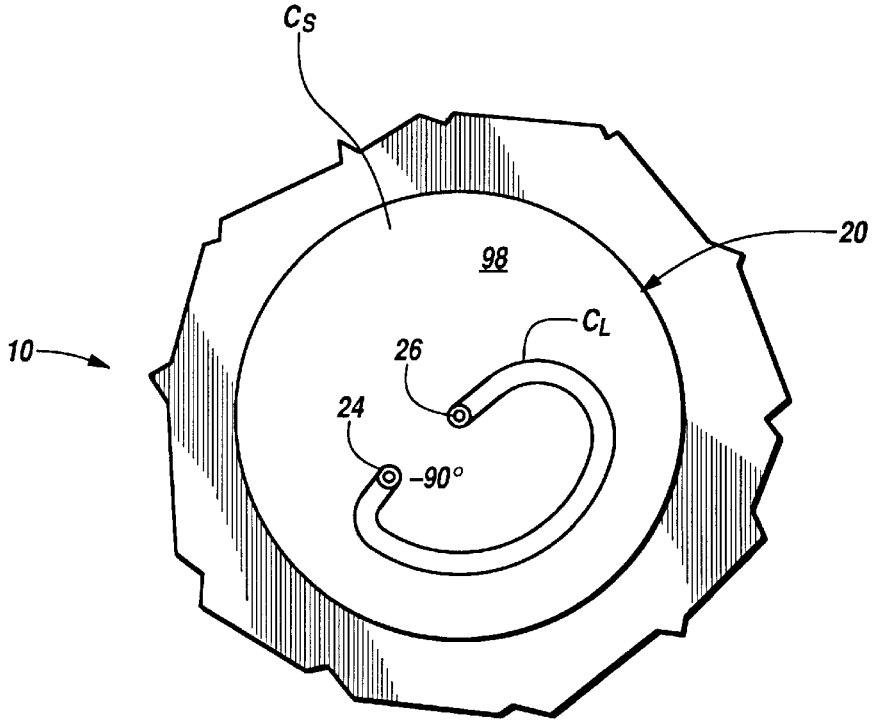
FIG. 4A is a partial plan view of the lower coupler and substrate of the 90° microstrip coupler of FIG. 4.

Referring now to FIGS. 4, 4A, 5 and 6, the coupler 20 is illustrated in more detail. The coupler 20 includes a lower dielectric substrate 96 of approximately 0.047 inch thickness and an upper dielectric substrate 98 of approximately 0.020 inch thickness (FIGS. 5 and 6). A lower coupler $C_L$ connects the input terminal 26 with the −90° output terminal 24 (FIG. 4A). The lower coupler $C_L$ includes a microstrip conductor disposed between the upper dielectric substrate 98 and the lower dielectric substrate 96 in an arcuate path from terminal 24 to terminal 26 (FIGS. 4A, 5 and 6). An upper coupler $C_U$ connects the 0° isolation output terminal 22 with a quarter wave length open stub $C_S$ (FIGS. 4, 5 and 6). The upper coupler $C_U$ includes a microstrip conductor disposed on top of the upper dielectric substrate 98 in an arcuate path from terminal 22 to the open stub $C_S$ (FIG. 4). Intermediate between isolated terminal 22 and the open stub $C_S$ is a 50-ohm surface mounted resistor 60 (FIG. 4). The isolation terminal 22 is terminated in the surface mounted 50-ohm resistor 60 to ground through the open stub $C_S$ (FIG. 4). The microstrip coupler 20 provides an input for the hi-band patch $P_H$ and lo-band patch $P_L$ to excite radiation in two orthogonal linear polarizations in quadrature from the antenna 10 (FIGS. 1 and 2).

Although the preferred embodiment of the invention has been illustrated in the accompanying Drawings and described in the foregoing Detailed Description, it will be understood that the invention is not limited to the embodiment disclosed but is capable of numerous modifications without departing from the scope of the invention as claimed.

We claim:

1. A stacked patch antenna comprising:

a lo-band patch having a first side and a second side;

a hi-band patch having a first side and a second side, said hi-band patch mounted adjacent with the second side adjacent to the first side of the lo-band patch; and a 90° microstrip coupler having a first layer and a second layer, said coupler mounted adjacent to the first side of the hi-band patch, said coupler including:

an input terminal, a 0° output terminal, a −90° output terminal, a lower coupler strip disposed in an arcuate configuration between the first layer of the coupler and the second layer of the coupler, said lower coupler strip connected to the input terminal and the −90° output terminal, and an upper coupler strip disposed in an arcuate configuration on the first layer of the coupler, said upper coupler strip connected to the 0° output terminal, and wherein said microstrip coupler generates two output quadrature signals fed to the hi-band patch and lo-band patch to produce circular polarization.

2. The stacked patch antenna of claim 1 further including:

a quarter wave length open stub disposed in an arcuate configuration on the first layer of the coupler and connected to the upper coupler strip.

3. The stacked patch antenna of claim 2 further including:

a resistor connected between the upper coupler strip and the quarter wave length open stub.

4. The stacked patch antenna of claim 1 wherein said lo-band patch includes a ground plane, further including:

a first conducting pin connecting the 0° output terminal of the 90° microstrip coupler with the ground plane of the lo-band patch; and a second conducting pin connecting the −90° output terminal of the 90° microstrip coupler with the ground plane of the lo-band patch.

5. The stacked patch antenna of claim 4 further including:

a coaxial input line, passing through a center-point of the hi-band patch and a center-point of the lo-band patch, and connected to the input terminal of the 90° microstrip coupler.

6. The stacked patch antenna of claim 1 wherein said lo-band patch includes a ground plane, further including:

a first conductor plated through a series of aligned openings in the lo-band patch, the hi-band patch and the microstrip coupler, connecting the 0° output terminal of the 90° microstrip coupler with the ground plane of the lo-band patch; and a second conductor plated through a series of aligned openings in the lo-band patch, the hi-band patch and the microstrip coupler, connecting the −90° output terminal of the 90° microstrip coupler with the ground plane of the lo-band patch.

7. The stacked patch antenna of claim 1 wherein the hi-band patch defines a ground plane for the 90° microstrip coupler.

8. The stacked patch antenna of claim 1 wherein a center-point of the lo-band patch and a center-point of the hi-band patch are at zero RF potential.

9. A stacked patch antenna comprising:

a first dielectric substrate having a first side and second side;

a second dielectric substrate having a first side and second side, said second dielectric substrate mounted adjacent to the first dielectric substrate;

a lo-band patch mounted between the first side of the first dielectric substrate and the second side of the second dielectric substrate;

a hi-band patch mounted adjacent to the first side of the second dielectric substrate; and a 90° microstrip coupler mounted adjacent to the hi-band patch, said coupler including:

a third dielectric substrate having a first side and a second side, a fourth dielectric substrate having a first side and a second side, an input terminal, a 0° output terminal, a −90° output terminal, a quarter wave length open stub disposed on the first side of the fourth dielectric substrate, a lower coupler strip disposed in an arcuate configuration adjacent to and between the first side of the third dielectric substrate and the second side of the fourth dielectric substrate, said lower coupler strip connected to the input terminal and the −90° output terminal, an upper coupler strip disposed in an arcuate configuration on the first side of the fourth dielectric substrate, said upper coupler strip connected to the 0° output terminal and the quarter wave length open stub, and a resistor connected between the upper coupler strip and the quarter wave length open stub, wherein said microstrip coupler generates two output quadrature signals that are fed to the hi-band patch and lo-band patch to produce circular polarization.

10. The stacked patch antenna of claim 9 wherein the lo-band patch includes a ground plane, further including:

a first conducting pin connecting the 0° output terminal of the 90° microstrip coupler with the ground plane of the lo-band patch; and a second conducting pin connecting the −90° output terminal of the 90° microstrip coupler with the ground plane of the lo-band patch.

11. The stacked patch antenna of claim 10 further including:

a coaxial input line, passing through a center-point of the hi-band patch and a center-point of the lo-band patch, and connected to the input terminal of the 90° microstrip coupler.

12. The stacked patch antenna of claim 9 wherein said lo-band patch includes a ground plane, further including:

a first conductor plated through a series of aligned openings in the first, second, third and fourth substrates, connecting the 0° output terminal of the 90° microstrip coupler with the ground plane of the lo-band patch; and a second conductor plated through a series of aligned openings in the first, second, third and fourth substrates, connecting the −90° output terminal of the 90° microstrip coupler with the ground plane of the lo-band patch.

13. The stacked patch antenna of claim 9 wherein the hi-band patch defines a ground plane for the 90° microstrip coupler.

14. The stacked patch antenna of claim 9 wherein a center-point of the lo-band patch and a center-point of the hi-band patch are at zero RF potential.

* * * * *